United States Patent [19]

Gillespy

[11] 4,236,319

[45] Dec. 2, 1980

[54] WARP SHEET SPLITTING DEVICE FOR A DRYING CHAMBER IN A YARN SIZING PROCESS

[75] Inventor: Keith R. Gillespy, Bolton, England

[73] Assignee: Platt Saco Lowell Limited, England

[21] Appl. No.: 911,656

[22] Filed: May 31, 1978

[30] Foreign Application Priority Data

Jun. 2, 1977 [GB] United Kingdom ..... 23332/77

[51] Int. Cl.[3] ..... F26B 7/00

[52] U.S. Cl. ..... 34/12; 28/180; 34/13; 34/60

[58] Field of Search ..... 34/12, 13, 60, 61; 118/68; 28/180

[56] References Cited

U.S. PATENT DOCUMENTS

| | | | |
|---|---|---|---|
| 2,572,288 | 10/1951 | Taylor et al. | 28/180 |
| 3,406,436 | 10/1968 | Tew | 28/180 |
| 3,584,392 | 6/1971 | Alexeff | 34/163 |
| 3,886,668 | 6/1975 | Remond et al. | 34/60 |

FOREIGN PATENT DOCUMENTS

| | | | |
|---|---|---|---|
| 1502604 | 3/1978 | United Kingdom | 28/180 |

*Primary Examiner*—John J. Camby

*Attorney, Agent, or Firm*—Donald H. Feldman

[57] ABSTRACT

In a sizing process for a warp sheet of yarns, a drying chamber has an upper first region, substantially void of a drying medium, and a second region containing the drying medium. A transversable warp splitting device is provided in the chamber which is traversable from the first region, where a plurality of splitting bars can be inserted through the warp sheet so as to split it into sheets of lesser density, to a second region, where the warp sheet is acted upon by the drying medium.

A cooling medium is provided between the first and second regions so as to prevent migration of the drying medium from the second region to the first region.

The splitting device comprises a carriage driven for movement along a track which extends in a downwardly inclined direction from the first region to the second region.

9 Claims, 2 Drawing Figures

WARP SHEET SPLITTING DEVICE FOR A DRYING CHAMBER IN A YARN SIZING PROCESS

BACKGROUND OF THE INVENTION

The present invention relates to the sizing and drying of a warp sheet of yarns. More particularly, the invention relates to a warp sheet splitting device for splitting the warp sheet of yarns into separate sheets of lesser density within a drying chamber.

In the drying chamber of a solvent sizing apparatus as shown, for example, in British Pat. No. 1 502 604, the warp sheet of yarn is split into sheets of lesser warp density by inserting tapes which are held apart in a splitting area so that splitting bars can be inserted to divide the warp sheet into the separate sheets of lesser density. It is difficult to ensure that there will be no heated solvent vapour in the splitting area with the result that there is danger to the operative when inserting the splitting bars to split the warp sheet.

It is an object of this invention to provide apparatus for and a method of drying a warp sheet of yarns in a sizing process which will enable an operative to split the warp sheet of yarns into sheets of lesser density conveniently and without danger.

SUMMARY OF THE INVENTION

These objects are achieved by the provision of apparatus for drying a warp sheet of yarns in a sizing apparatus including a drying chamber through which the warp sheet of yarns passes so as to be acted upon by a drying medium, and a warp sheet splitting device comprising a carriage provided with a plurality of splitting bars, the carriage being traversable within the drying chamber from a first position, in which the splitting bars are inserted through the warp sheet so as to split the warp sheet into sheets of lesser density, to a second position, in which the drying medium effects a drying action on the split warp sheets.

Preferably the drying chamber has a first region substantially void of a drying medium, and a second region containing the drying medium, the warp splitting device comprising a carriage provided with a plurality of splitting bars, the carriage being traversable between the first region, in which the splitting bars are inserted through the warp sheet so as to split the warp sheet into sheets of lesser density whilst in isolation from the drying medium, and the second region, in which the drying medium effects a drying action on the split warp sheets.

These objects are also achieved in a sizing process by a method of drying a warp sheet of yarns in a drying chamber having a first region, substantially void of a drying medium, and a second region, containing a drying medium for drying the warp sheet, comprising the steps of inserting a plurality of splitting bars through the warp sheet to split it into sheets of lesser density in the first region of the chamber, traversing the splitting bars into the second region, and forwarding the sheets of lesser density through the second region whereby the drying medium effects a drying acting thereon.

DESCRIPTION OF THE PREFERRED EMBODIMENT

Figure 1:
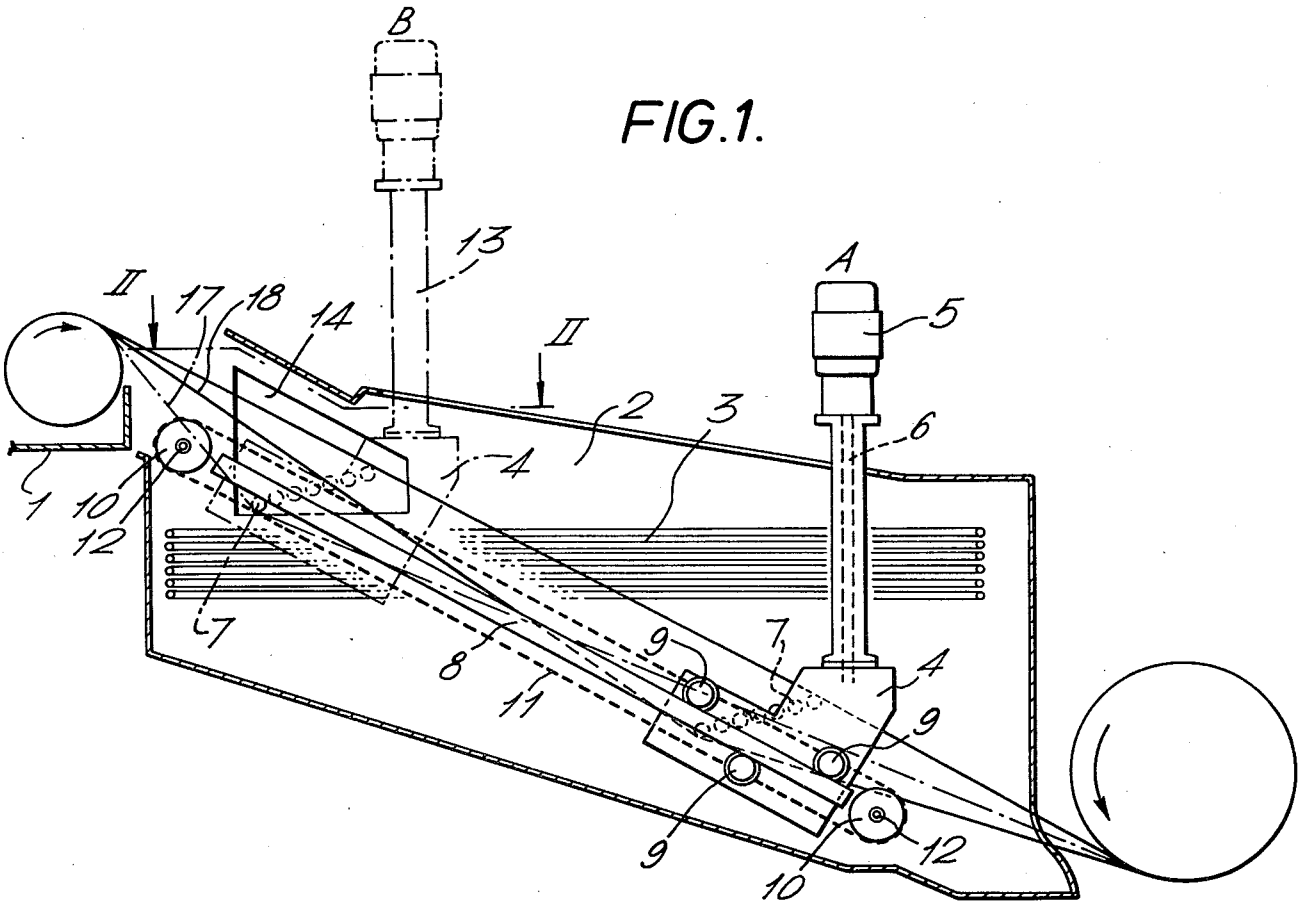
FIG. 1 is a longitudinal cross section elevation of a drying chamber in a sizing apparatus.
Figure 2:
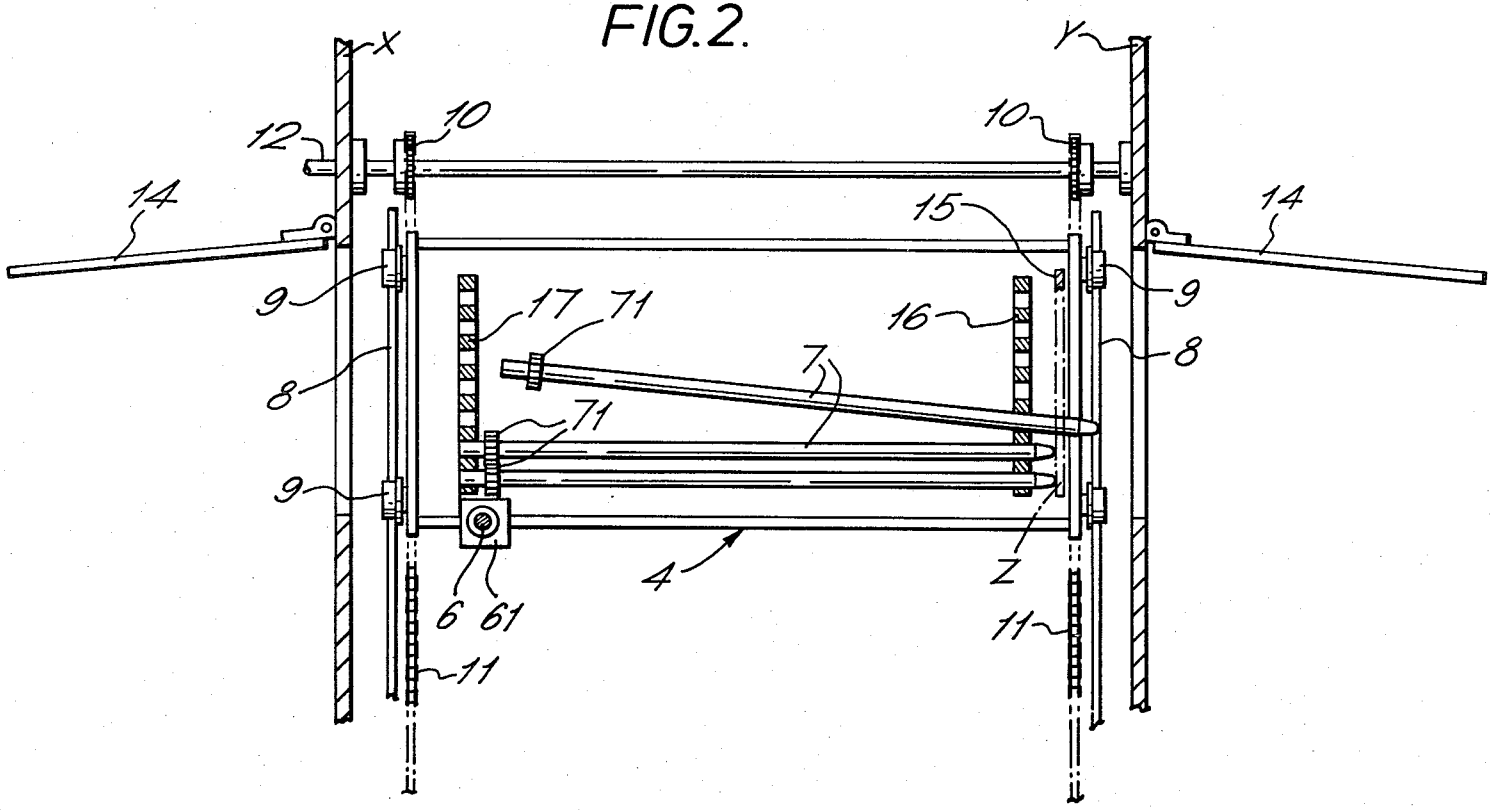
FIG. 2 is a part plan view of a warp splitting arrangement within the drying chamber of FIG. 1 along line II—II, with the carriage in a position for insertion of the splitting bars.

With reference to the drawings, the apparatus comprises a size box 1 for applying a quantity of solvent based size to a warp sheet. A substantially closed drying chamber 2 has upper and lower regions separated by a conduit 3 containing cooling water, the lower region having means (not shown) for projecting and collecting a solvent drying medium. The cooling effect of the cooling water in the conduit 3 prevents migration of the solvent drying medium from the lower drying region to the upper region which is therefore substantially free of drying medium. A warp splitting unit within the drying chamber 2 comprises a carriage 4, which extends across the width of the machine. The carriage 4 supports a motor 5 for driving a shaft 6 which in turn drives through suitable gearing a plurality of warp splitting bars 7 thereby to assist in forwarding the warp sheets through the drying chamber. The splitting bars 7 extend substantially across the width of the machine. The carriage 4 is traversably mounted on a track formed by bars 8 inclined downwardly from the upper region to the lower region and which are mounted within the chamber at each side thereof. Guide rolls 9 run on opposite sides of the inclined bars 8 and support the carriage 4 for motion therealong under the control of a conveyor. The conveyor comprises two pulleys 10 and a chain 11 at each side of the machine for moving the carriage. A motor (not shown) drives a shaft 12 on which are mounted two pulleys 10 and thereby turns the chains 11 which are bolted to the carriage 4 thus traversing the carriage 4 along the inclined bars 8. The motor which drives the conveyor has a braking arrangement fitted thereto, so that by stopping the motor and applying the brake, the carriage 4 can be stopped in any desired position. The numeral 17 indicates a divided warp sheet position when the carriage 4 is in the upper region of the chamber 2 and numeral 18 indicates the same warp sheet when the carriage is in the lower region of the chamber 2.

In operation when threading up the sizing machine the warp sheet is divided into separate sheets of lesser density by inserting tapes therethrough. The divided warp sheet is then forwarded into the size box 1 and into the dryer 2. The carriage 4 of the warp splitting unit is then traversed up the inclined bars 8 (by means of the motor driving the conveyor chain 11) to a position as indicated by dotted line 13 at position 'B' in the upper region of the chamber 2. Side doors 14 provided in each side wall X, Y of the machine are opened to allow access to the carriage at the position 'B'.

In this position, an end stopping bar 15 is raised to allow splitting bars to be manually passed through the opening in the wall 'X' between the warp sheets and through one of a plurality of apertures in a bearing 16. The bar is then pulled back toward the wall 'X' to locate the near end in the respective aperture in a bearing 17. Each splitting bar carries a gear 71 at one end thereof whereby, when all the bars are located in the bearings 16, 17, the gears 71 mesh to form a continuous drive chain whereby the bars can be driven via a gear box 61 by the shaft 6. When all the splitting bars are so located, the end stopping bar 15 is lowered to the position shown in dotted outling 'Z' to prevent axial movement of the bars 7 out of the bearings 16, 17 and the disengagement of the gears 71.

At this time the doors are closed and the carriage 4 lowered by operation of the motor (not shown) to a predetermined level within the lower region of the chamber 2. The split warp sheets are then forwarded so as to be subjected to a drying operation in the lower region of the chamber by the application thereto of a heated solvent vapour.

Thus the invention overcomes a disadvantage associated with the solvent sizing process by enabling the warp sheet to be split into sheets of lesser density in a safe and convenient manner.

I claim:

1. Apparatus for drying a warp sheet of yarns in a sizing process, including a drying chamber through which the warp sheet may be passed so as to be acted upon by a drying medium, said chamber having a first spacial region substantially devoid of any drying medium and a second spacial region for containing a drying medium, a condenser within said chamber intermediate said first and second spacial region whereby drying medium from said second region may be condensed and thus be prevented from migrating to said first region, a warp splitting device within said chamber comprising a carriage and a plurality of warp splitting bars insertable into said carriage, and carriage traversing means for traversing said carriage between said first region, whereat said bars may be inserted into said carriage in safety to split said warp sheet into sheets of lesser density while in isolation from said drying medium, and said second region, whereat said drying medium may effect drying of said split warp sheets.

2. Apparatus according to claim 1, wherein said condenser includes a conduit for containing a cooling medium positioned within the chamber between the first and second regions, whereby the effect of the cooling medium may be such as to prevent migration of the drying medium from the second region to the first region.

3. Apparatus according to claim 1, wherein the first region is at an upper portion of the chamber and the second region is at a lower portion of the chamber, and wherein said carriage traversing means includes a track which supports the carriage for movement between the first and second regions, the track being inclined downwardly from the first region to the second region.

4. Apparatus according to claim 3, wherein said carriage traversing means further includes carriage driving means drivingly connected to the carriage for moving the warp splitting device along the track between the first and second regions.

5. Apparatus according to claim 4, wherein the carriage driving means includes an endless chain attached to the carriage, the chain extending between the first and second regions in an inclined direction substantially parallel with the track.

6. Apparatus according to claim 1, wherein said warp splitting device further includes splitting bar driving means drivingly connected to the splitting bars for rotating the bars and for thus forwarding the warp sheet through the chamber.

7. Apparatus according to claim 6, wherein the splitting bar driving means includes a gear wheel mounted on each of the splitting bars, each gear wheel in meshing engagement with the gear wheel of an adjacent splitting bar to form a continuous driving connection therebetween.

8. Apparatus according to claim 7, wherein the splitting bar driving means further includes a motor drivingly connected to the warp splitting bars, said motor being mounted on the carriage for movement therewith.

9. In a sizing process, a method of drying a warp sheet of yarns in a drying chamber having a first region, substantially void of a drying medium, and a second region, containing a drying medium for drying the warp sheet, comprising the steps of:

inserting a plurality of splitting bars through the warp sheet to split it into the sheets of lesser density in the first region of the chamber, traversing the splitting bars into the second region, and forwarding the sheet of lesser density through the second region whereby the drying medium effects a drying action thereon.

* * * * *